US007731081B2

(12) United States Patent
Liang

(10) Patent No.: US 7,731,081 B2
(45) Date of Patent: Jun. 8, 2010

(54) PAPER BOX STRUCTURE

(75) Inventor: Yu-Chieh Liang, Taipei County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 208 days.

(21) Appl. No.: 11/976,367

(22) Filed: Oct. 24, 2007

(65) Prior Publication Data

US 2009/0026251 A1 Jan. 29, 2009

(30) Foreign Application Priority Data

Jul. 25, 2007 (TW) ..... 96127151 A

(51) Int. Cl.
*B65D 5/46* (2006.01)

(52) U.S. Cl. ..... 229/120.13; 229/120.04; 229/117.13

(58) Field of Classification Search ..... 229/120.04, 229/120.03, 120.02, 120.05, 120.13, 120.18, 229/120.24, 120.37; 220/503, 504, 520; 206/588, 593, 736, 45.21, 45.26, 723, 701, 206/722, 784

See application file for complete search history.

(56) References Cited

U.S. PATENT DOCUMENTS 4,978,006 A * 12/1990 Juteau ..... 206/449
7,097,043 B2 * 8/2006 Hsu ..... 206/784

FOREIGN PATENT DOCUMENTS

JP 06032374 A * 2/1994

* cited by examiner

*Primary Examiner*—Nathan J Newhouse
*Assistant Examiner*—Christopher Demeree
(74) *Attorney, Agent, or Firm*—Rabin & Berdo, PC

(57) ABSTRACT

A paper box structure is formed of a paper material, and comprises a bottom plate and two side plates connected to both sides of the bottom plate. Each side plate comprises a top plate connected to one side of the side plate opposite to the bottom plate; and the other two sides of the side plate is connected with a main body fold plates respectively. Each main body fold plate comprises a frame plate having a central opening, a buffer plate; and at least one adjustable fold plate formed along both sides of the central opening. The frame plate is folded to form a U-shaped buffer space together with the top plate, the side plate and the bottom plate. The buffer plate is connected to one side of the frame plate near the side plate, and folded to form a step-like structure.

14 Claims, 6 Drawing Sheets

PAPER BOX STRUCTURE

RELATED APPLICATIONS

This application claims priority to Taiwan Application Serial Number 96127151, filed Jul. 25, 2007, which is herein incorporated by reference.

BACKGROUND

1. Field of Invention

The present invention relates to a paper box structure.

2. Description of Related Art

As shown in FIG. 1, for fabricating a conventional paper box, a side plate 200', a connecting tongue plate 210' and a plurality of wing plates 300' are formed on a paper board, and then the side plate 200' and the connecting tongue plate 210' are connected to form a duct structure, and thereafter an adhering or stapling method is used to close the open ends of the duct structure with the wing plates 300'. Referring to FIG. 2, a box structure with a handle part is shown. To fabricate the structure, two through holes 301' and a supporting structure 302' are formed at the upper side of the box body, a handle part 400' is disposed at those two through holes 301', and a plurality of wing parts 103' located at the lower side of the box body are engaged with one another; thus a tubular structure with an open end at the lower side can be formed from the side plate 201' without adhering or stapling. Further, while fragile products such as high precision electronic products and glass products are placed in the aforementioned box body, the box body has to be filled with buffer material such as Styrofoam and sponge for protecting the product disposed therein.

However, in the aforementioned box body structure, at least one area has to be applied with the method of adhering or stapling while being assembled. Thus, besides the material of the box body itself, the elements such as adhesive and pins have to be prepared, thus increasing fabrication cost. On the other hand, the handle part and the buffer material are generally made of plastic material which leads to environmental issue.

SUMMARY

One aspect of the present invention is to provide box structure, wherein only a paper material is need for forming a handle part, a box body for receiving an article, and a buffer space for resisting the impact to protect the article received therein.

Another aspect of the present invention is to provide a box structure for corresponding different volumes and shapes of various articles received therein by simply changing a buffer space to adjust the size of the accommodation space in the box body.

In accordance with the aforementioned aspects, the box structure of the present invention is formed by folding a thin sheet of paper material, and comprises a bottom plate and two side plates connected to two opposite sides of the bottom plate. Each of the side plates comprises a top plate connected to one side of the side plate opposite to the bottom plate; and the other two sides of the side plate is connected with a main body fold plates respectively. Each of the main body fold plates comprises a frame plate, a buffer plate and at least one adjustable fold plate. The frame plate has an opening formed in a central portion thereof, and can form a U-shaped buffer space together with the top plate, the side plate and the bottom plate after folding. The buffer plate is connected to one side of the frame plate near the side plate, and can be folded to form a step-like buffer structure. The adjustable fold plate is formed along two opposite sides of the opening of the frame plate, and is folded to form a buffer space or accommodation space in accordance with demands.

The top plate comprises a handle part located on a central portion of the top plate. The top plate further comprises a tongue plate and a slot, wherein the tongue plate is engaged with the slot when the paper box structure is closed.

The paper box structure of the present invention further comprises an enhancing plate, wherein the enhancing plate is connected to either the top plate or the main body fold plate.

Further, a slot is formed on the buffer plate, and a tongue plate is formed on the sidewall of the opening of the frame plate opposite to the slot. After folding the frame plate and the buffer plate, the relative positions are fixed by inserting the tongue plate into the slot.

Moreover, a tongue plate is formed on an edge of the top plate, and a slot is formed on the main body fold plate. After folding the top plate, the relative positions are fixed by inserting the tongue plate of the top plate into the slot of the main body fold plate.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
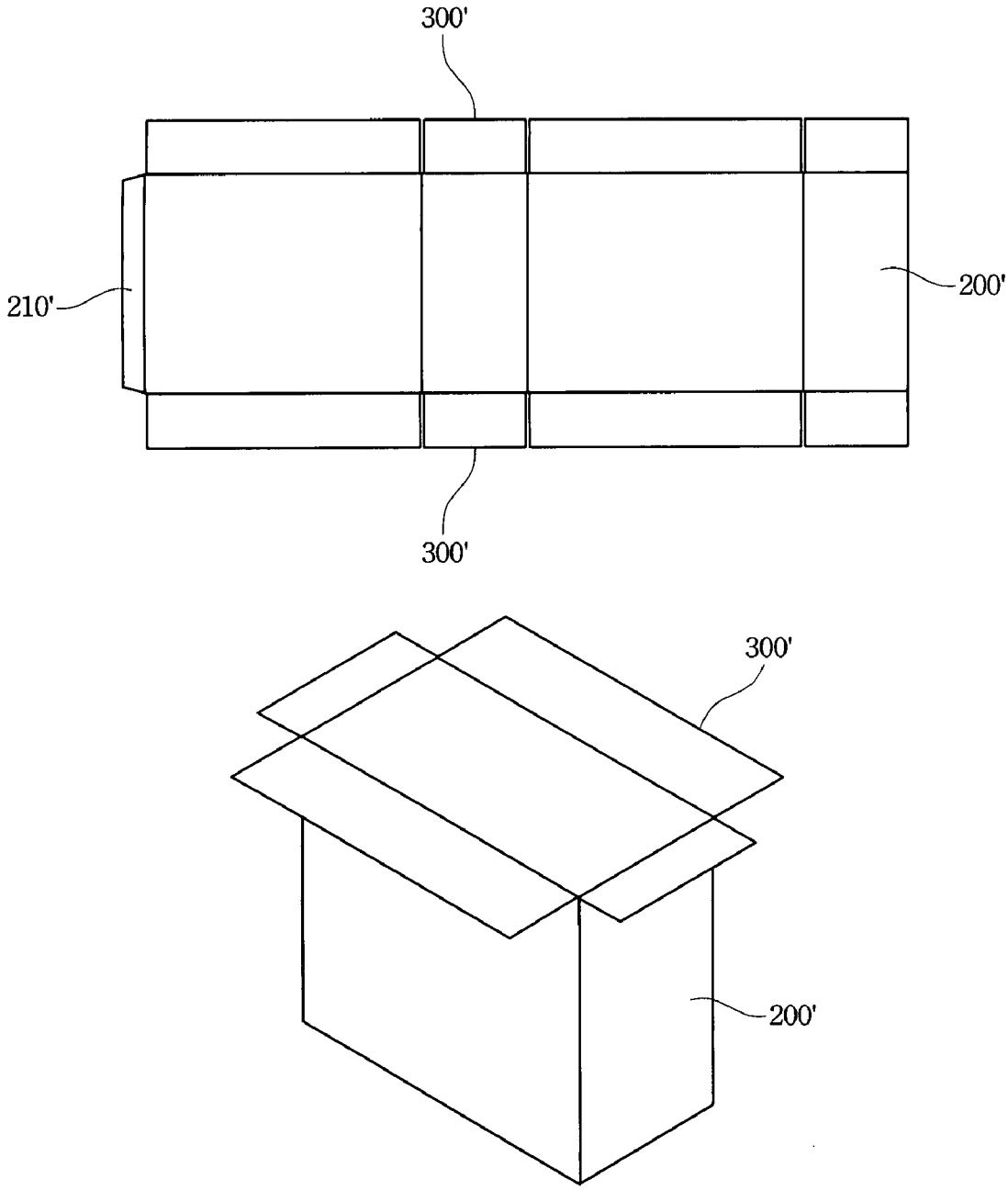
FIG. 1 (PRIOR ART)
FIG. 1 illustrates both 3-D diagram and expanded planar diagram of a conventional paper box.
Figure 2:
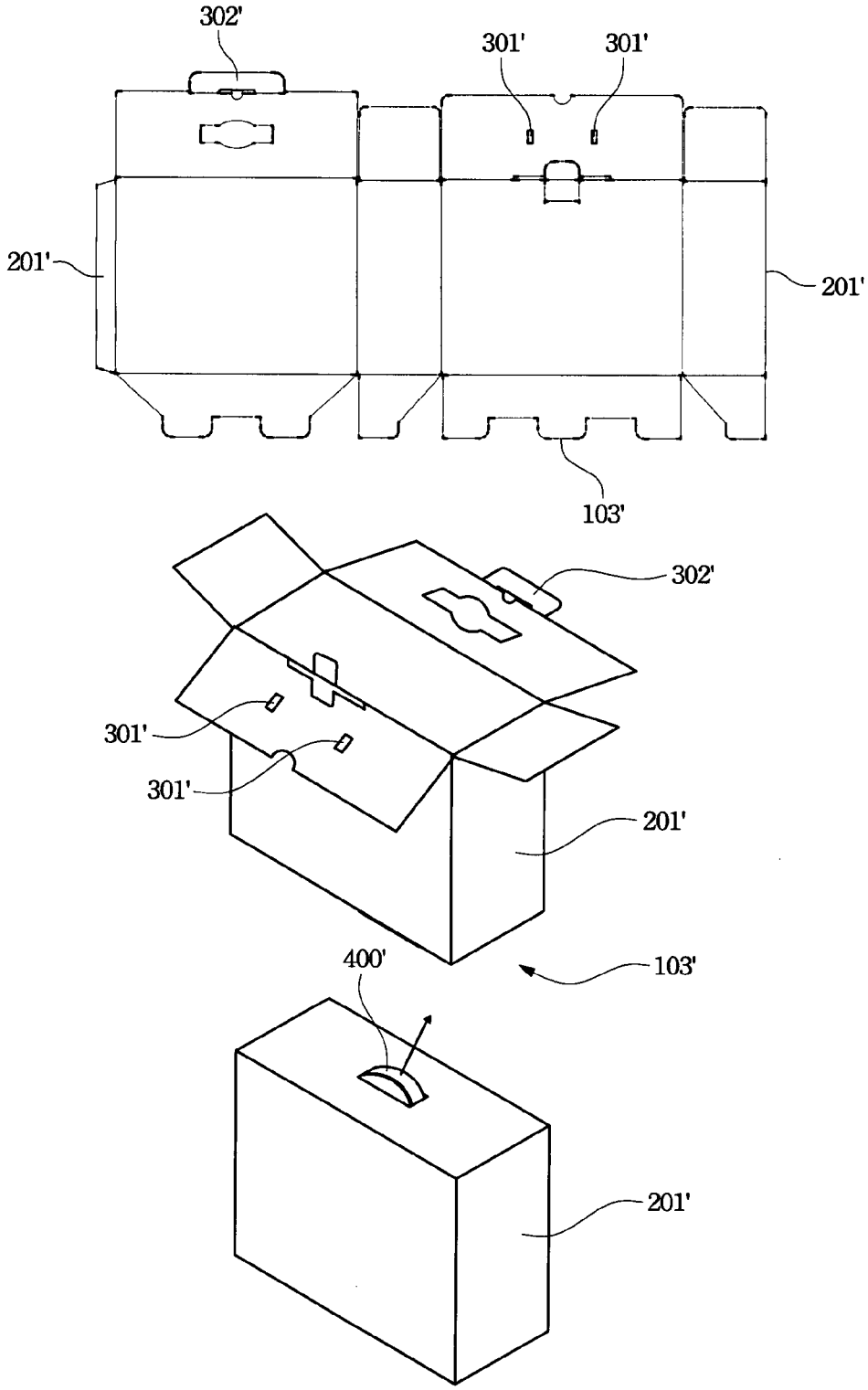
FIG. 2 (PRIOR ART)
FIG. 2 illustrates both 3-D diagram and expanded planar diagram of another conventional paper box.
Figure 3:
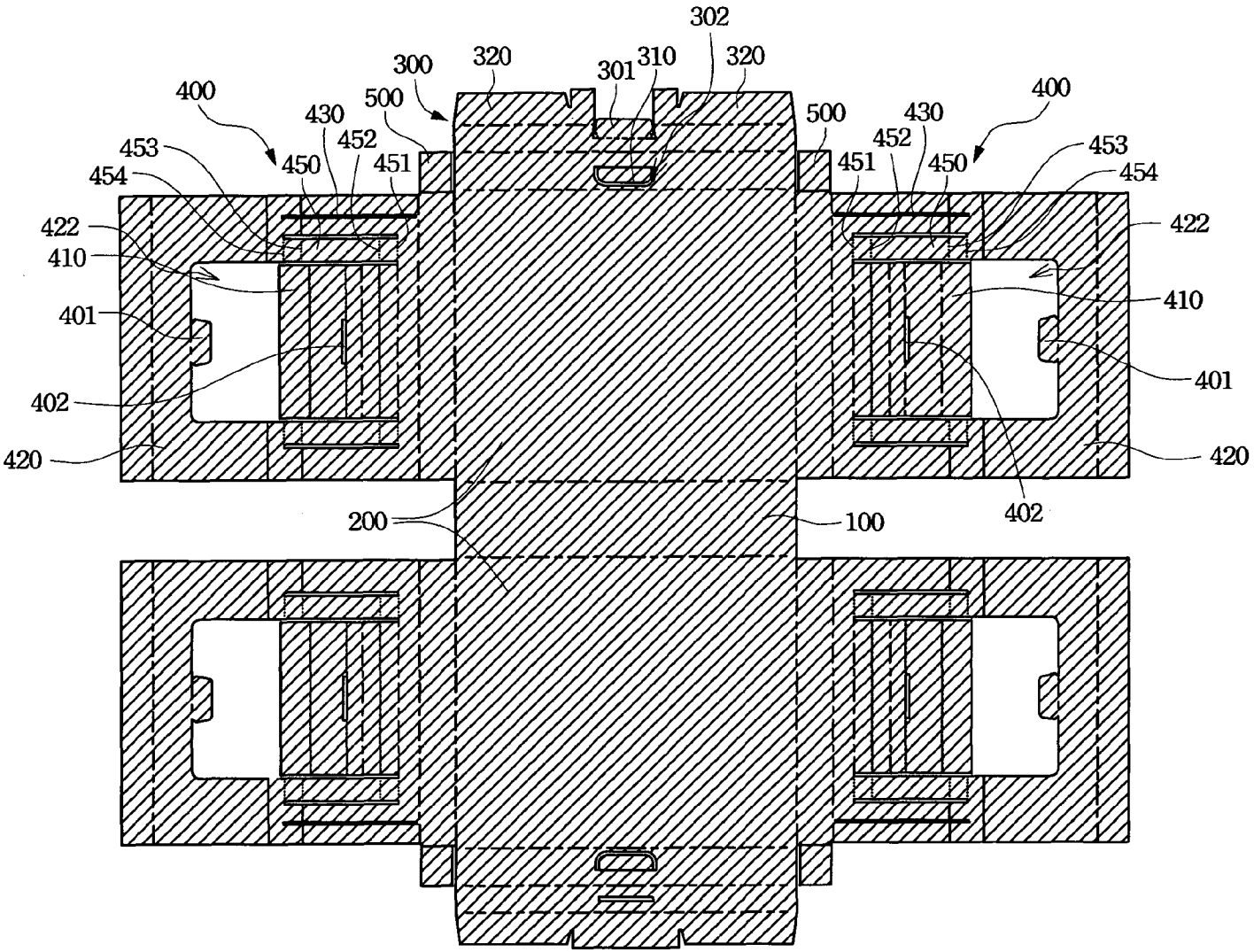
FIG. 3 is an expanded planar diagram of the paper box according to an embodiment of the present invention.
Figure 4:
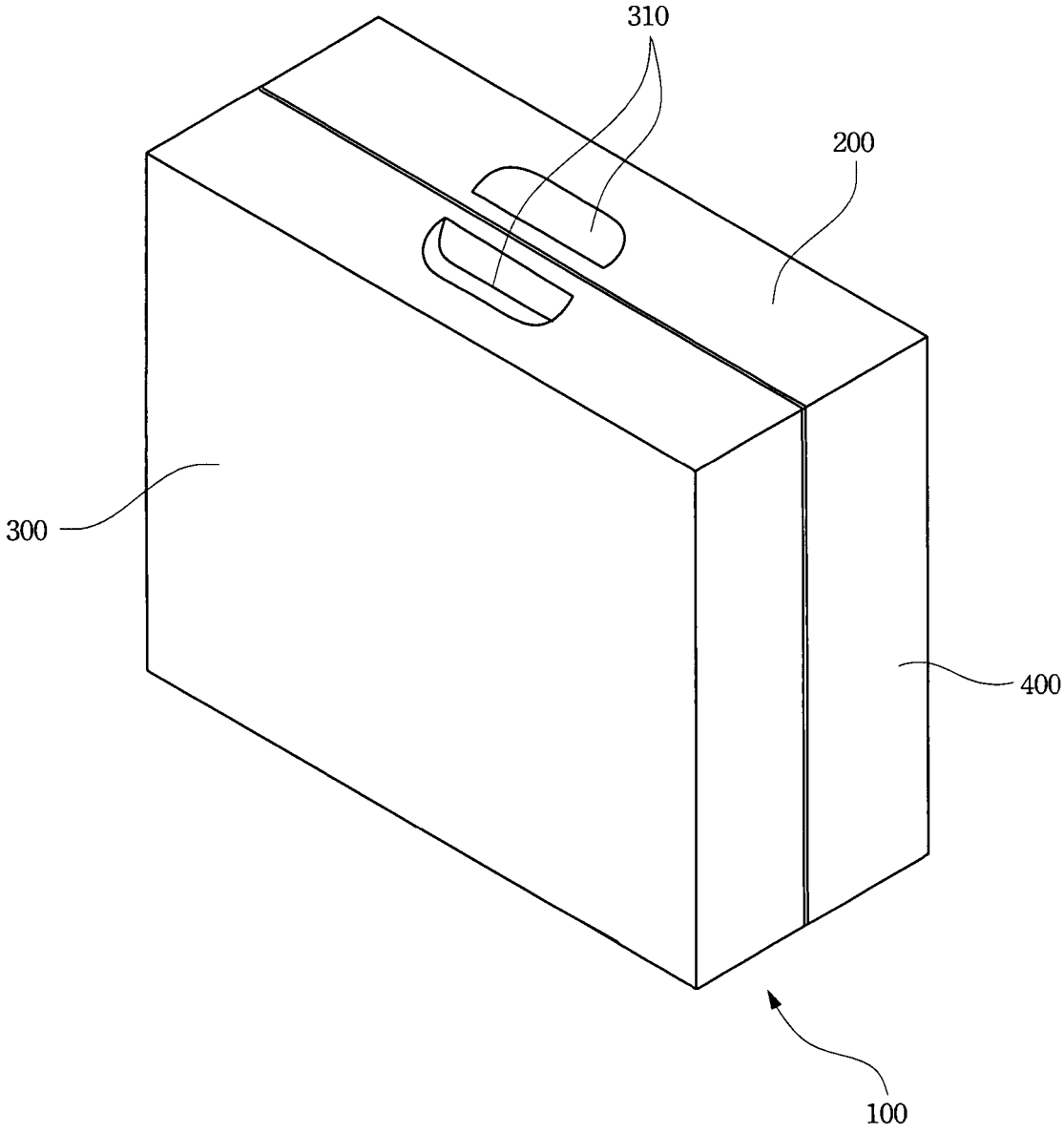
FIG. 4 is a 3-D diagram showing a paper box structure at a close state according to an embodiment of the present invention.
Figure 5:
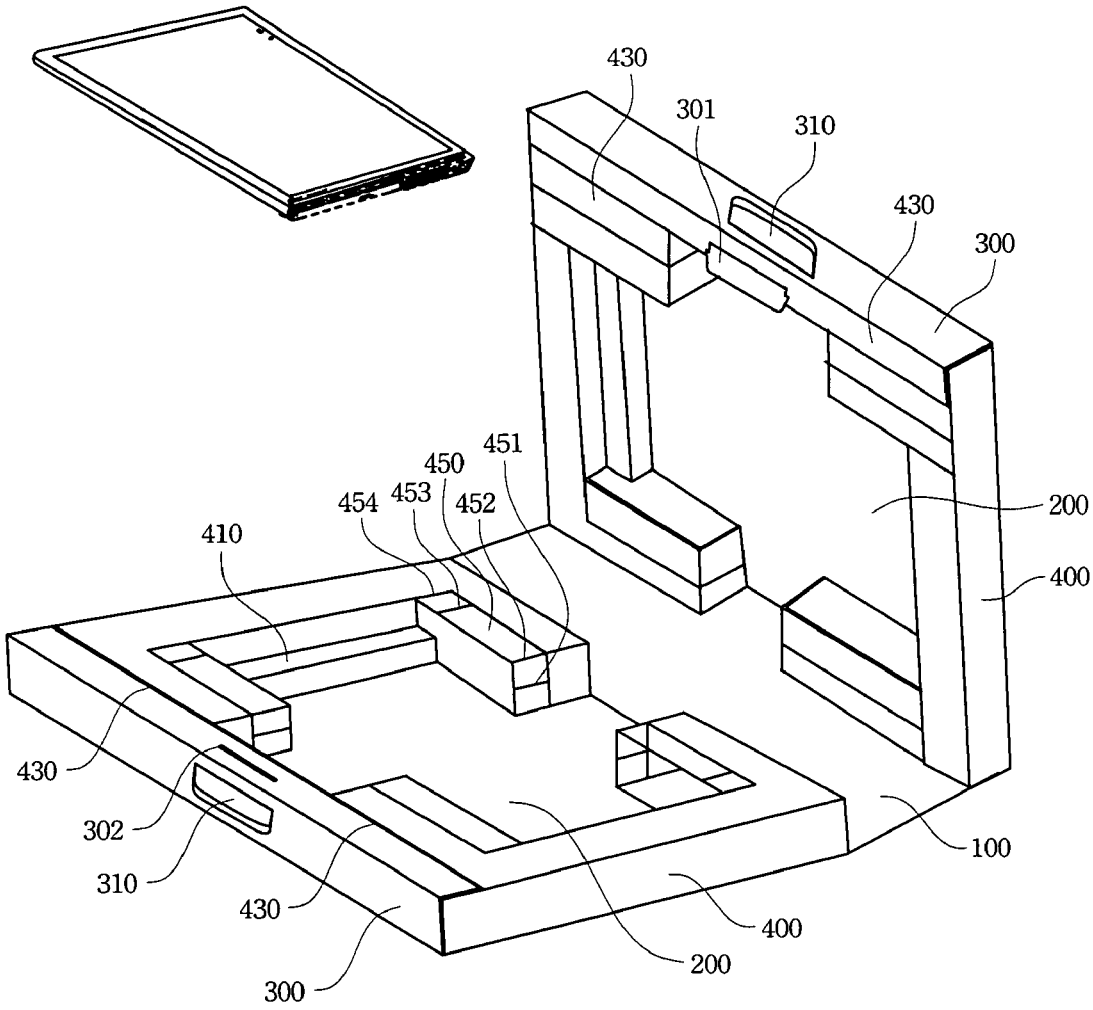
FIG. 5 is a 3-D diagram showing the paper box structure at an open state according to the embodiment of the present invention.
Figure 6:
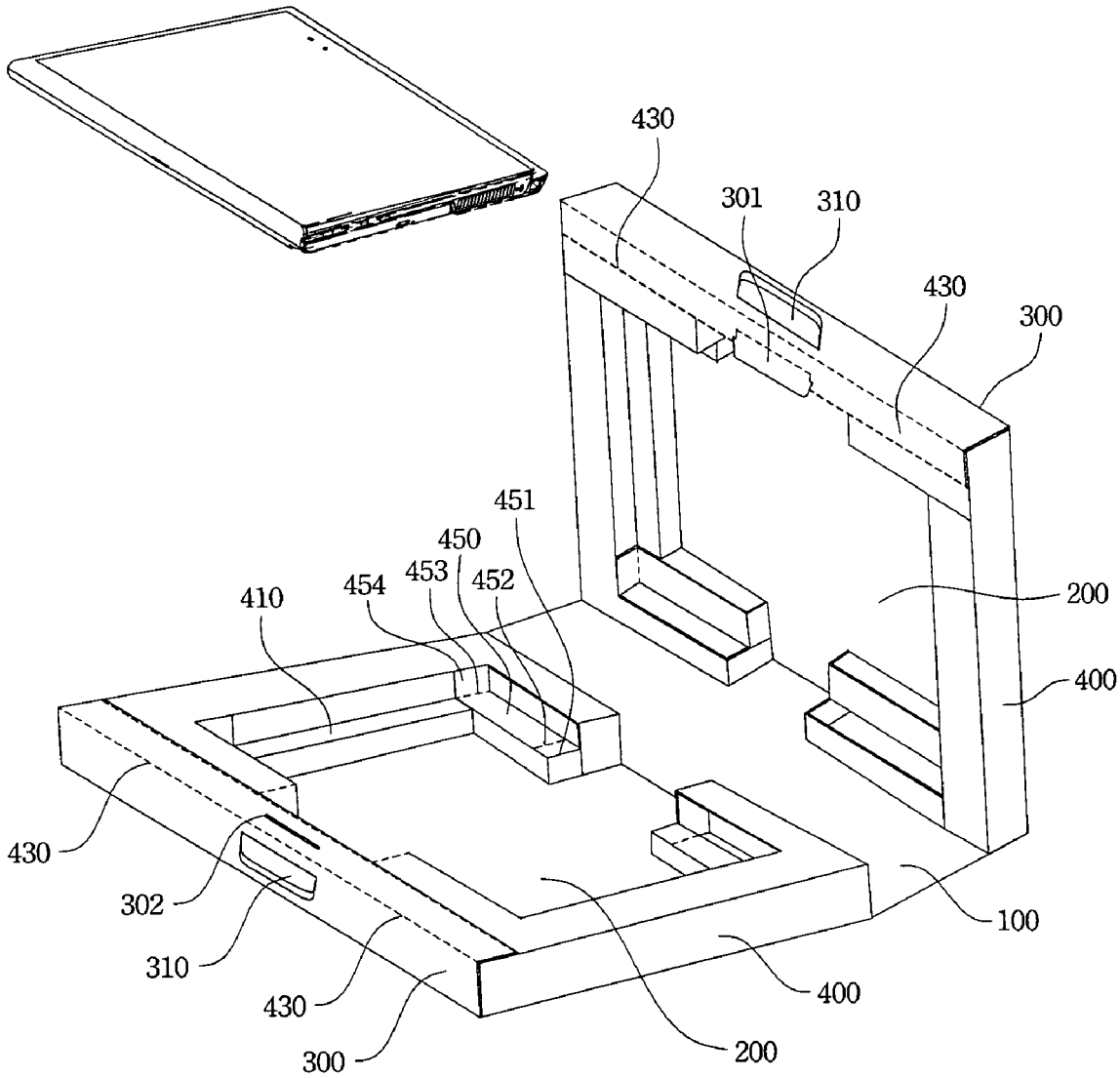
FIG. 6 is a 3-D diagram showing a paper box structure at an open state according to another embodiment of the present invention.

FIG. 3 is an expanded planar diagram of the paper box according to an embodiment of the present invention. As shown in FIG. 3, the dash-dot line "— - —" represents a mountain fold line, wherein a worker folds both sides of the mountain fold line to force the mountain fold line to be convex outwards, thereby protruding the mountain fold line; a dash line "- - - " represents a valley fold line, wherein a worker folds both sides of the mountain fold line to force the mountain fold line to be convex inwards, thereby recessing the valley fold line; a dot line ". . . " represents an optional fold line in accordance with the articles to be received in the box. Accordingly, the expanded planar diagram shown in FIG. 3 can be folded to form a box body as shown in FIG. 4, FIG. 5, or FIG. 6. The oblique lines shown in FIG. 3 are merely used for clearly showing the configuration and empty portions in the diagram, and do not intend to limit the paper material orientation or any other items.

Concretely speaking, a thin sheet of paper material is first used to form the pattern shown in FIG. 3, and the forming method thereby is not specifically limited, for example, conventional methods such as mold pressing, cutting, etc can be adopted. The thin sheet of paper material itself is not particularly limited, as long as the material has a specific strength, foldable and not being damaged easily. The thin sheet of paper material can be made of single-layer or multiple-layer of corrugated paper, carton paper or plastic or metal sheet. In view of the processing and environmental protection, corrugated paper is preferred.

The pattern shown by FIG. 3 comprises a bottom plate 100 and two side plates 200 connected to two opposite sides of the bottom plate 100. Each side plate 200 has a top plate 300 connected to one side of the side plate 200 opposite to the bottom plate 100, and the other two sides of the side plate 200 is connected with a main body fold plates 400 respectively.

The thin sheet of paper material having the pattern shown in FIG. 3 can be folded along the mountain and valley fold lines therein to form a box structure as shown in FIG. 4, FIG. 5 or FIG. 6, wherein the folding step is not particularly limited, but is preferably performed by first folding the main body fold plates 400; then folding the top plates 300; and then folding the connection areas between the respective side plates 200 and the bottom plate 100.

Each main body fold plate 400 comprises a buffer plate 410, a frame plate 420 and at least one adjustable fold plate 450. An opening formed in a central portion of the frame plate 420 can form a U-shaped buffer space together with the top plate 300, the side plate 200 and the bottom plate 100 after folding. The buffer plate 410 is connected to one side of the frame plate 420 near the side plate 200. In the present embodiment, the buffer plate 410 is folded along the aforementioned mountain and valley fold lines to form a step-like buffer structure as shown in FIG. 5 or FIG. 6, wherein the surface of the step-like buffer structure is used to hold an article and the space therebelow is used as a buffer space. A slot 402 is formed on the buffer plate 410, and a tongue plate 402 is formed on the sidewall of the opening of the frame plate 410 opposite to the slot 402. Insert the tongue plate 401 into the slot 402 after folding the frame plate 420 and the buffer plate 410, and the relative positions between the frame plate 420 and the buffer plate 410 can be fixed without using adhesive or pins. The adjustable fold plates 450 are formed along two opposite sides of the opening of the frame plate 420, and each adjustable fold plate 450 comprises four optional fold lines 451, 452, 453 and 454. These four optional fold lines may be folded as mountain fold lines, valley fold lines, or not folded based on the desired accommodation space. For example, in the present embodiment, as shown in FIG. 5, when a relatively small article is desired to be placed in the box, the optional fold line 452 of the adjustable fold plate 450 is chosen to be a mountain fold line for forming a relatively small accommodation space, and the adjustable fold plate 450 itself also forms a buffer space. As shown in FIG. 6, when a relatively large article is desired to be placed in the box, the optional fold lines 451 and 454 of the adjustable fold plate 450 are chosen to be mountain fold lines, and the optional fold lines 453 of the adjustable fold plate 450 are chosen to be valley fold lines and meanwhile the optional fold line 452 is not folded, thereby forming a relatively large accommodation space.

A set of tongue plates 320 is formed on a top edge of the top plate 300. After folding the top plate 300, the tongue plate 320 of the top plate 300 is inserted into a slot 430 formed on the main body fold plate 400, thereby fixing the relative positions between the top plate 300 and the main body fold plate 400 without using adhesive or pins.

The paper box structure of the present invention further comprises an enhancing plate 500 connected to either the top plate 300 or the main body fold plate 400. In the present embodiment, the enhancing plate 500 is connected to the main body fold plate 400 and is adjacent to the top plate 300. The enhancing plate 500 is used to strengthen the connection line between the top plate 300 and the main body fold plate 400 by inserting the enhancing plate 500 into the space formed by folding the top plate 300.

The box structure as shown in FIG. 4, FIG. 5 or FIG. 6 are completed by folding all the respective parts of the thin sheet of paper material in accordance with the aforementioned steps, wherein the bottom plate 100 is formed as the bottom of the box structure; two sets of side plates 200, the top plate 300 and two main body fold plates 400 are formed as the side and top thereof which are connected to two opposite edges of the bottom plate 100, thus forming a pair of open box bodies having an accommodation space used for receiving an article and a buffer for resisting impact.

Besides, as shown in FIG. 4, FIG. 5 or FIG. 6, each of the two top plates 300 further comprises a tongue plate 301 and a corresponding slot 302 for engaging while the pair of open box bodies are closed with each other. The top plate 300 further comprises a handle part 310 located on a central portion of the top plate 300, wherein the handle part 310 is folded to form an opening convenient for hand carrying.

Various applications can be performed within the technical thoughts of the present invention. For example, the actual size of the box can be determined in accordance with the size of the article desired to be received therein. The embodiment shown in FIG. 3 to FIG. 6 shows a substantially central symmetrical box structure, however the box structure of the present invention also can be formed asymmetrically in accordance with the actual situations. For example, in the box structure shown in FIG. 5, the horizontal box portion may be formed with relatively large thickness, and the upright box portion may be formed with relatively small thickness. Accordingly, such application examples should be fall within the scope of the following claims.

It can be known from the aforementioned embodiments, the application of the present invention has the following advantages.

1. The relative positions of the respective parts of the box structure can be fixed without using adhesive and pins, thus saving cost and meeting environmental requirements;

2. The buffer space is formed directly from the thin sheet of paper material, and no extra buffer material is needed;

3. The size of the accommodation space can be adjusted in accordance with the volume and size of different article simply by changing the buffer space; and 4. The handle part is formed directly from the thin sheet of paper material, and no extra part is needed, thus simplifying the assembly process.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper box structure formed of a paper material, comprising:

a bottom plate; and a first side plate connected to a first side of the bottom plate;

a second side plate connected to a second side of the bottom plate opposite to the first side of the bottom plate;

a first top plate connected to a top side of the first side plate opposite to the bottom plate;

a second top plate connected to a top side of the second side plate opposite to the bottom plate;

two first main body fold plates each connected to opposite sides of the first side plate, each of the first main body fold plates comprising a first frame plate with a first opening formed in a central portion of the first frame plate;

a first buffer plate connected to one side of the first frame plate near the first side plate, the first frame plate being folded to form a first U-shaped buffer space together with the first top plate, the first side plate and the bottom plate, and at least one first adjustable fold plate formed along two opposite sides of the first opening of the first frame plate, the at least one first adjustable fold plate being foldable to form a first buffer space or accommodation space;

two second main body fold plates each connected to opposite sides of the second side plate, each of the second main body fold plates comprising a second frame plate with a second opening formed in a central portion of the second frame plate;

a second buffer plate connected to one side of the second frame plate near the second side plate, the second frame plate being folded to form a second U-shaped buffer space together with the second top plate, the second side plate and the bottom plate, and at least one second adjustable fold plate formed alone two opposite sides of the second opening of the second frame plate, the at least one second adjustable fold plate being folded to form a second buffer space or accommodation space.

2. The paper box structure as claimed in claim 1, wherein the first top plate comprises a handle part located on a central portion of the first top plate.

3. The paper box structure as claimed in claim 1, wherein the first top plate comprises a tongue plate, and the second top plate comprises a slot, and the tongue plate is engaged with the slot when the paper box structure is closed.

4. The paper box structure as claimed in claim 1, further comprising:

an enhancing plate connected to the first top plate and is adjacent to the first main body fold plate.

5. The paper box structure as claimed in claim 1, further comprising:

an enhancing plate connected to the first main body fold plate and is adjacent to the first top plate.

6. The paper box structure as claimed in claim 1, wherein a slot is formed on the first buffer plate, and a tongue plate is formed on a sidewall of the first opening of the first frame plate corresponding to the slot, and the tongue plate is inserted into the slot after folding the first frame plate and the first buffer plate, thereby fixing the relative positions between the first frame plate and the first buffer.

7. The paper box structure as claimed in claim 1, wherein a tongue plate is formed on an edge of the first top plate, and a slot is formed on the first main body fold plate, and the tongue plate of the first top plate is inserted into the slot of the first main body fold plate after folding the first top plate, thereby fixing the relative positions between the first top plate and the first main body fold plate.

8. The paper box structure as claimed in claim 1, wherein the second top plate comprises a handle part located on a central portion of the second top plate.

9. The paper box structure as claimed in claim 1, further comprising:

an enhancing plate connected to the second top plate and adjacent to the second main body fold plate.

10. The paper box structure as claimed in claim 1, further comprising:

an enhancing plate connected to the second main body fold plate and adjacent to the second top plate.

11. The paper box structure as claimed in claim 1, wherein a slot is formed on the second buffer plate, and a tongue plate is formed on a sidewall of the second opening of the second frame plate corresponding to the slot, and the tongue plate is inserted into the slot after folding the second frame plate and the second buffer plate, thereby fixing the relative positions between the second frame plate and the second buffer plate.

12. The paper box structure as claimed in claim 1, wherein a tongue plate is formed on an edge of the second top plate, and a slot is formed on the second main body fold plate, and the tongue plate of the second top plate is inserted into the slot of the second main body fold plate after folding the second top plate, thereby fixing the relative positions between the second top plate and the second main body fold plate.

13. The paper box structure as claimed in claim 1, wherein each of the at least one first adjustable fold plate comprises four fold lines that are foldable as mountain fold lines or valley fold lines, or not folded to form the first buffer space or accommodation space in accordance with demands.

14. The paper box structure as claimed in claim 1, wherein each of the at least one second adjustable fold plate comprises four fold lines that are foldable as mountain fold lines or valley fold lines, or not folded to form the second buffer space or accommodation space in accordance with demands.

* * * * *